United States Patent [19]

Bodzian et al.

[11] Patent Number: 4,828,456

[45] Date of Patent: May 9, 1989

[54] FAN UNIT AND A METHOD OF MANUFACTURING THE GUIDE VANES OF SUCH A UNIT

[75] Inventors: Gerd Bodzian, Soderweg; Heinz Wieland, Morikestr, both of Fed. Rep. of Germany

[73] Assignee: Wilhelm Gebhardt GmbH, Waldenburg, Fed. Rep. of Germany

[21] Appl. No.: 163,446

[22] Filed: Mar. 3, 1988

[30] Foreign Application Priority Data

Mar. 3, 1987 [DE] Fed. Rep. of Germany ..... 3706772

[51] Int. Cl.[4] ..... F15D 1/00; F04D 3/00

[52] U.S. Cl. ..... 415/211.1; 415/209.1; 415/210.1

[58] Field of Search ..... 415/209, 211, 210, 206, 415/207, 199.2, 199.3, 199.6; 98/42.07, 42.13; 417/352, 353, 354

[56] References Cited

U.S. PATENT DOCUMENTS

| | | | |
|---|---|---|---|
| 1,375,595 | 4/1921 | Lamontagne | 415/199.2 |
| 1,429,538 | 9/1922 | Schetzal | 417/423 R |
| 1,822,945 | 9/1931 | Weis | 415/199.2 |
| 3,069,071 | 12/1962 | Carlson | 415/209 |
| 3,117,770 | 1/1964 | Campbell | 415/210 |
| 3,329,415 | 7/1967 | Cowan | 415/209 |

FOREIGN PATENT DOCUMENTS

| | | | |
|---|---|---|---|
| 0029799 | 7/1987 | Japan | 415/211 |
| 2048382 | 3/1980 | United Kingdom | 415/210 |

*Primary Examiner*—Robert E. Garrett
*Assistant Examiner*—Michael V. Readey
*Attorney, Agent, or Firm*—Steven L. Permut; Malcolm L. Sutherland

[57] ABSTRACT

The invention relates to a fan unit comprising a tubular external housing which has inlet and outlet connectors placed coaxially one behind in the other. A radial impeller have backwardly directed vanes. A distributor surrounds the radial impeller and positioned downstream thereof. The distributor is secured on an inner side of the housing and having a plurality of guide vanes extending axially and circumferentially spaced around the periphery. The vanes are adapted to deflect the flow of impelled fluid radially emerging from the impeller to an axial direction and which are so inclined at an angle of attack, which is selected in accordance with the direction of emergence of the impelled fluid in relation to the axis of rotation of the radial impeller that a smooth even flow transition takes place in the distributor. The ring of guide vanes coaxially surrounds the impeller with a clearance gap of substantially constant width. As viewed along the axial direction the beginning of the guide vanes is placed behind the beginning of the impeller vanes at their outer periphery and the guide vanes end behind the impeller vanes. The middle section of the guide vanes have an inwardly directed bend. The invention also relates to a method of producing guide vanes in such a novel fan unit.

22 Claims, 2 Drawing Sheets

FAN UNIT AND A METHOD OF MANUFACTURING THE GUIDE VANES OF SUCH A UNIT

TECHNICAL FIELD

The present invention relates to a fan unit comprising a tubular external housing which has inlet and outlet connectors placed coaxially one behind the other and a radial impeller without any spiral housing and arranged so as to rotate freely with a motor drive. The radial impeller has backwardly directed vanes for impelling a gaseous medium. A distributor surrounds the radial impeller externally and placed downstream in the direction of flow. The distributor is mounted on an inner side of the housing and has a plurality of guide vanes extending axially and evenly arranged around the periphery. The vanes are adapted to deflect the flow of impelled fluid radially emerging in an axial direction and which are so inclined at an angle of attack, which is selected in accordance with the direction of emergence of the impelled fluid relative to the axis of rotation of the radial impeller so that a smooth even flow transition takes place in the distributor. The invention further relates to a method of producing the guide vanes of a fan of the above mentioned type.

BACKGROUND OF THE INVENTION

Particular fan units often referred to as tubular fans, are directly fitted in ducting for air or air/gas mixtures which are axially drawn in and axially blown longitudinally through the ducting.

It is common that, due to expense, axial fans for moving air or other media are used in conjunction with a distributor, diffusor or guide device on the output end for directing the emerging air. These fans, however, have disadvantages due to relatively poor efficiency, high noise level, and allowing the air to emerge with a spin. Because the spin energy transferred to the air by the impeller is not able to be converted back into pressure which can be utilized and, consequently, remains in the form of rotational energy in the output flow. A waste of power and a high noise level results. Furthermore, the spin still present, in the fluid, such as air being moved, produces low frequency sound vibrations of the ducting and secondary sound emission is transferred to the further downstream fixtures fitted in the ducting.

Suggestions have already been made to use radial fans in the ducting, in the case of which the impeller is placed in a radially symmetrical housing with coaxially placed inlet and outlet connectors. The air emerging radially from the impeller is redirected back in an axial direction to the outlet connector. The air is brought together with the aid of an air outlet cone narrowing towards the outlet connector. Such fans combine the advantages of an axial type of fan; that is to say straight through flow, with those of a radial fan; namely, a high pressure and a relatively low level of noise. These fans have become very popular for some applications. Their assembly is simple, just as simple for example as the fitting of a length of ducting or tubing, the air outlet being aligned in direction with the air inlet, that is to say axially.

Known arrangements of the type in question here do, however, have the disadvantage that the air emerges with a substantial spin from the impeller so that the volumetric flow continues to move helically even in the next part of the ducting or tubing system and this leads to a substantial loss of power. A large proportion of the energy imparted to the fluid is not able to be utilized so that the efficiency of such fans is correspondingly poor. Accordingly, an attempt was made (see the German unexamined specification No. 3,439,780) to arrange guide vanes in the outlet cone in order to contribute to the recovery of spin energy into pressure which might be utilized. However, the guide vanes forming a guide grid in the cone did not produce sufficient effects and furthermore the manufacture of the housing and the outlet cone is not economical. A further proposal made in U.S. Pat. No. 3,650,633 involved the provision of a cylindrical housing in order to simplify manufacture. A disadvantage with this system is that there has to be an internal cylinder coaxially placed downstream from the impeller and forming the hub of the impeller. Guide vanes are arranged between the internal cylinder and the outer housing. In this arrangement, the emerging air is substantially free of spin but the flow pattern has an annular cross section so that in the following duct it is necessary for the air to be distributed over the full cross section. This involves a sudden increase in the cross section which causes relatively high losses.

Finally, a proposal has been made in the German unexamined specification No. 1,628,335 to design a fan unit with a freely rotating radial impeller without a spiral housing and which was operably connected to a drive motor and acted on the gaseous fluid in an axial direction and expelled it in a radial direction. A guiding means or distributor was set thereon on the inner side of the external fan housing and had a plurality of guide vanes extending in the axial direction to deflect the fluid flow emerging from the radial impeller in an axial direction. This previously proposed device thus has the features of a fan as specified initially herein but however it was so designed that the laminar flow of the fluid originally produced at the point of deflection was converted into a turbulent fluid flow owing to the form of the annular gap through which it had to pass and owing to the conical form of the housing. A further disadvantage of the design was that the effective area decreases at the point of deflection toward the inlet port and this also tends to lead to turbulence. The flow of fluid has to overcome a relatively high resistance to flow and there is a danger of repeated turbulence producing effects acting on the flow. Consequently, the flow transition between the radial impeller and the distributor needs substantial improvement. On incorporation of this known system in piping or ducting there may be difficulties as regards attachment of the housing within the tubes and furthermore manufacturing of the fan unit is relatively involved owing to the configuration of the vanes and to the structure of the housing.

SUMMARY OF THE INVENTION

In accordance with one aspect of the invention, a fan unit has a ring of guide vanes coaxially surrounding the impeller with a clearance gap of substantially constant width between the inner edges of the guide vanes and the associated outer edges of the impeller vanes. As seen in the axial flow direction, the beginning of the guide vanes is placed behind the beginning of the impeller vanes at their outer periphery and the guide vanes end behind the end of the impeller vanes. The axial length of the guide vanes preferably is greater than the axial length of the impeller vanes. In the middle section of the guide vanes, as viewed in a longitudinal section comprising the axis, the guide vanes have an inwardly directed bend such that each first respective half has its longitudinal center axis forming an obtuse angle with the axis of the second half thereof which is less than 180 degrees. The housing is preferred to have a nozzle-like inlet running in the direction of flow centrally and pointing towards the interior of the impeller from the end wall of the external housing at the inlet end and at the outlet end wall of the external housing there is a centrally arranged nozzle-like intake extending in the direction of flow away from the impeller towards the outside. In this respect the inner edge of the guide vane may have a step at which it comes radially closer to the impeller, such step being for example at the bend. The internal diameter of the guide vanes becomes suddenly smaller, for example, at the inwardly projecting step so that the internal diameter of the vane may run obliquely inward toward the inner edge of the guide vane. It is preferred if, as seen in the direction of flow, the step is located behind the impeller vane end by a distance which is generally equal to the width of the clearance gap. The arrangement may, for instance, be such that in the radial direction the guide vanes are not curved and lie radially in respective planes passing through the axis of rotation of the impeller. The guide vanes, for instance, may be curved in the axial direction and run along a circular arc. The arrangement may also be such, for instance, that the outlet edges of the guide vanes lie in respective planes that are approximately parallel to the axis, while the inlet edges, for instance, of the guide vanes are set against the direction of rotation of the impeller at an angle of approximately 20 to 30 degrees and preferably 25 degrees. Preferably the number of guide vanes is approximately 1.5 to 2.5 times the number of impeller vanes.

In this fashion, the guide vanes produce an emerging air flow that is practically free of spin and the emerging air is from the outset evenly distributed or at least approximately so, over the full cross section of the outlet connector and owing to the minimum turbulence of the air the flow energy is able to be converted into utilizable pressure in an optimum manner. The arrangement is also distinguished by the feature that it is suitable for connection to tubular ducting with a wide range of different diameters. A further beneficial effect of the invention is that manufacturing of the fan unit may take place in a simple, non problematical and economic manner.

In accordance with another aspect of the invention, given here only by way of example, manufacturing of the guide vanes starts with a strip of sheet metal as a blank whose breadth is greater than the length of the guide vanes as measured in the axial direction and in this strip, starting at its one, first longitudinal edge guide vanes are cut out toward the other second longitudinal edge in accordance with the contour of the guide vane in the longitudinal direction of the sheet metal blank so that the vanes sequentially follow each other and are adjacent to each other leaving a connecting section adjacent to the second longitudinal edge. The connecting section of the consecutive guide vanes form a centering strip continuously along the second longitudinal edge, and from the centering strip there extend separate retainer lugs each attached to the connecting section and each fits between the facing head parts of the guide vanes toward the first longitudinal edge. The cutting out of the guide vanes is undertaken in such a manner that they remain connected with the associated retainer lug along a connecting line starting at the centering strip. The guide vanes joined together via the centering strips are plastically deformed so as to have a configuration extending along an arc and then the guide vanes are bent along the connection line through 90 degrees. Finally, the centering strip is curled so that its external diameter is equal to the internal diameter of the external housing. In this respect, in order to enhance strength of the distributor, it is possible to have a reinforcing ring, as for example one made of round wire, within the tips of the guide vanes. It is clear that when this method is used, manufacture becomes simple and inexpensive.

In this fashion a fan unit for incorporation in ducting is able to be simply and economically manufactured.

Furthermore, a fan unit is provided that involves optimum conversion of the flow energy into available pressure (i.e. pressure that may be used).

Furthermore, the invention provides substantially equal distribution of the inlet air over the full cross section of the outlet connector without the fluid flow being made turbulent. Furthermore the emerging flow is free of spin.

A still further advantage of the invention is to provide such a fan unit which may be connected with different types of ducting having different diameters.

BRIEF DESCRIPTION OF THE DRAWINGS

Reference now will be made to the accompanying drawings in which.

DETAILED DESCRIPTION OF THE PREFERRED EMBODIMENT

Figure 1:
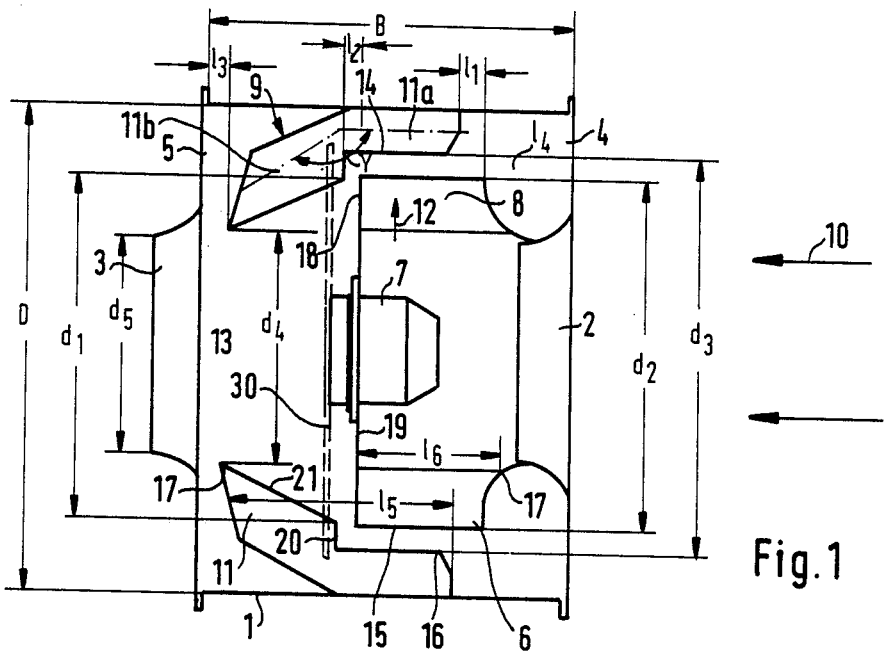
FIG. 1 is a diagrammatic section in the plane of the axis of a fan unit in accordance with the invention.

The fan unit seen in FIG. 1 of the drawing possesses a tubular external housing 1 having coaxial inlet and outlet connectors 2 and 3, respectively, placed in axial alignment. The end wall 4 adjacent to the inlet of the external housing 1 is provided with a nozzle-like intake directed into the interior of the impeller and placed centrally so as to extend in the direction of flow. The end wall 5 of the external housing is provided with a centrally arranged nozzle-like intake extending in the direction of flow toward the exterior away from the impeller. The external housing 1 encompasses a freely rotating radial impeller 6 with backwardly curved vanes 8, which is constructed without having any spiral housing and is driven by a drive motor 7 which may be incorporated within the unit or attached to it on the outside thereof. The air passes through the nozzle 2 axially into the radial impeller which is designed for impelling air (or another gaseous fluid), and the air is then expelled radially outward via the impeller vanes 8. The radial impeller 6 is externally surrounded radially by a distributor or diffusor 9. The distributor 9 is affixed to the inside of the external housing 1 and has a number of guide vanes 11 extending in the direction of the arrow 10 and which are circumferentially spaced about the periphery of the distributor or of the external housing 1. Preferably there are 1.5 to 2.5 as many guide vanes 11 as there are impeller vanes 8. The guide vanes 11 deflect the air leaving the radial impeller in the radial direction as indicated by the arrow 12 to an axial direction as indicated by the arrow 10. And to this end, the guide vanes are set at an angle of attack, selected in accordance with the direction of emergence of the fluid, so as to be oblique in relation to the axis 13 of rotation of the radial impeller with the result that there is a smooth and even flow transition into the distributor.

The ring of vanes 11 of the distributor 9 surrounds the impeller 6 coaxially leaving a gap $1_4$ therebetween having a more or less constant width between the inner edges 14 of the guide vanes 11 and the associated outer edges 15 of the impeller vanes 8. As viewed in the axial direction of flow, the front end 16 of the guide vanes is behind the front end 17 of the impeller vanes at their outer periphery. The guide vanes end behind the impeller vanes with their tips 17 being behind the ends 18 of the impeller vanes that abut the floor plate 19.

Figure 2:
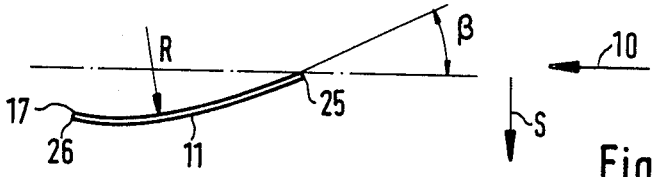
FIG. 2 shows the guide vane profile in a longitudinal radial section.

The length of the guide vanes $1_5$ as measured in the axial direction is greater than the length of the impeller vanes $1_6$. The guide vanes 11 extend in the radial direction without any curvature so as to lie radially in the respective planes extending through the axis 13 of rotation of the impeller 6. The guide vanes are curved in the axial direction as more clearly shown in FIG. 2, in which a guide vane axial profile is shown looking radially outward from the center axis. The direction of flow again being referenced 10 and the direction of rotation S of the impeller as referenced by the arrow. The guide vanes 11 extend in a curved manner along a circular arc (FIG. 2), whose radius R is such that the ratio between it and the external diameter $d_2$ of the impeller is between 0.63 and 0.8 to 1 and preferably is 0.71 to 1. The exit or trailing edges of the guide vanes 11 extend so as to be more or less axially parallel while the inlet or leading edges of the guide vanes on the other hand are set against the direction of rotation of the impeller by about 20 to 30 degrees, and preferably 25 degrees as is indicated in FIG. 2 as the angle. As seen in FIG. 1, the guide vanes 11 viewed in a section containing the axis, has respective middle parts bent towards the interior and are set so that the respective first half 11*a* of their longitudinal center axis is at an obtuse angle $\beta$ to the axis of the second half 11*b*, such angle being less than 180 degrees. At the commencement of the bend, the inner edge of the guide vane 11 is stepped towards the impeller, such step being indicated by 20 in FIG. 1. At this step 20, the internal diameter of the guide vane becomes abruptly smaller and from this step onwards the inner edge 21 of the guide vane 11 extends obliquely inwards. The step 20 is behind the end of the impeller vane 8 (i.e. the floor plate 19) by a distance indicated as $1_2$. Distance $1_2$ is approximately the same as the width of the gap $1_4$. The ratio between this distance $1_2$ and external diameter $d_2$ of the impeller is between 0.03 and 0.06 to 1 or more especially 0.045 to 1. It is to be noted that it is an advantage if the diameter $d_4$ at the exit end tip 17 of the guide vane is such that the ratio between it and the diameter $d_4$ at the exit end tip 17 of the guide vane is such that the ratio between it and the diameter $d_5$ of the nozzle-like intake 3 at the outlet side 5 of the external housing is between 1.3 and 1.6 to 1 and more especially 1.45 to 1, while the distance $1_3$ from the outlet tip 17 of the guide vane 11 to the outlet side end wall 5 of the external housing has a ratio between it and the diameter D of the external housing of 0.02 to 0.05 to 1 and more particularly 0.03 to 1. The external diameter $d_2$ of the impeller vane and the maximum internal diameter $d_1$ at the inwardly directed step are approximately equal in size and the ratio between them is conveniently 1 to between 0.8 and 1.1 and more particularly 1 to 0.96. The line measured in the axial direction between the beginning of the impeller vane 8 and that of the guide vane 11, which is denoted as distance $l_1$ has a ratio between it and the length of the impeller vane(also measured in the axial direction) of between 0.1 and 0.3 to 1 and preferably 0.16 to 1. On the other hand the internal diameter $d_3$ of the guide vane is approximately 1.1 to 1.2 times the external diameter $d_2$ of the impeller and preferably 1.13 times the external diameter $d_2$ of the impeller. These ratios serve to optimize the configuration of the guide vanes taking into account the form and size of the impeller in such a way that on the one hand there is the best possible transition from the impeller to the distributor and on the other hand there is a very satisfactory flow behavior, with an outlet air flow practically free of spin and this having only a small loss of energy. In the case of tubular fans, the main task is that of ensuring the smoothest possible outlet flow and the lowest possible losses of energy.

Figure 3:
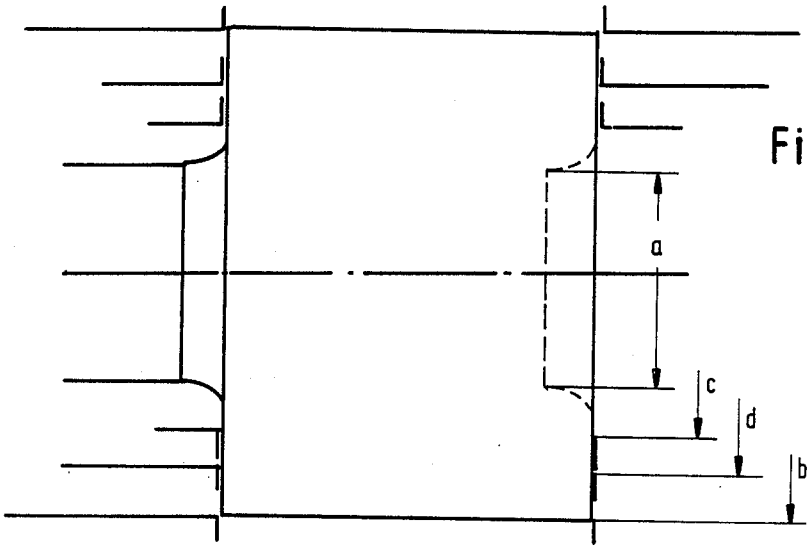
FIG. 3 shows in diagram different possible ways of connecting the fan unit of the invention as seen from the side.

The fan unit in accordance with the invention is extraordinarily adaptable with regards to its possibilities of connection as shown in FIG. 3. A fan unit according to the invention may be incorporated in existing minimum size tubular ducting with a diameter a and in large-size tubular ducting with a diameter b and also, however with ducting with a medium diameter c or d, for example. Other intermediate diameters may also be envisaged. It is also possible to select different diameters for the inlet and outlet ends. From the present brief description it is possible to visualize the substantial adaptability and variability of the arrangement in accordance with the invention, in which moreover the axial length B of the external housing may have a ratio between it and the diameter D thereof between 1.65 and 1.8 to 1 and preferably 1.7 to 1, this rendering the overall arrangement particularly compact and space-saving.

Moreover the inlet or leading edge of the guide vane is denoted 25 in the view of FIG. 2 while here the outlet or trailing edge of the guide vane is referenced 26. In FIG. 1 the holding struts for the motor are to be noted which are to be seen at 30.

Figure 4:
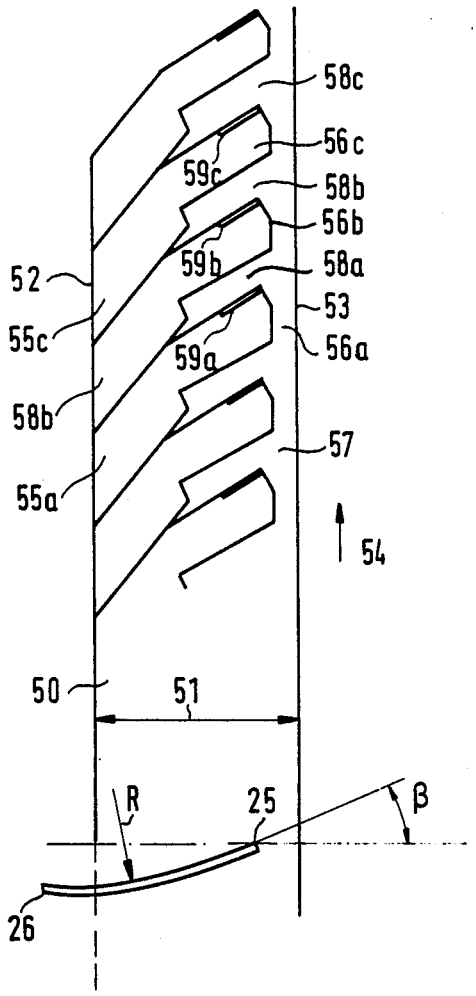
FIG. 4 is a schematic view showing the manufacture of the guide vanes in keeping with the invention.

The invention furthermore provides a particularly expedient, simple method for the manufacture of the guide vanes of a fan unit of the above described type. The steps taken in such a method are now explained with reference to FIG. 4.

The blank used is a strip 50 of sheet metal, whose breadth 51 is larger than the length of the guide vane as measured in the axial direction. Starting at the first longitudinal edge 52 of the sheet metal blank a number of consecutive, mutually adjacent guide vanes 55*a*, 55*b*, 55*c* etc. are cut out coming one after the other along the length direction 54 of the sheet metal strip blank towards the second longitudinal edge 53 of the sheet metal strip. As is also indicated in FIG. 1, it is possible to leave a connecting part 56*a*, 56*b*, 56*c* etc. These connecting parts of the consecutive guide vanes then form a centering strip 57, which extends continuously along the second longitudinal edge 53 of the sheet metal strip blank and from which retainer lugs 58*a*, 58*b*, 58*c* etc. extend towards the first longitudinal edge 52, such lugs respectively belonging to a connecting part and fitting between the adjacent head parts of the respective guide vanes, so that projections extending towards the opposite longitudinal edge are in engagement with the center strip 57 and simultaneously separating the individual guide vanes from each other. These projecting retainer lugs do however have a further function. On cutting out the guide vanes it is necessary to see that they remain connected with the associated retainer lug along a connecting line 59*a*, 59*b*, 59*c* etc. extending from the centering strip so that they are not completely separated from the centering strip with its projections. Afterwards the guide vanes attached to the centering strip are plastically deformed in the form of a circular arc, that is to say to conform to an arc as described in connection with FIG. 2. After this the guide vanes are bent upwards along the connection line 59*a*, 59*b*, 59*c* etc. through 90 degrees so that the vane now has its form provided in the distributor. Lastly the centering strip is so curled that its internal diameter is the same as the internal diameter of the external housing. The distributor may now be fitted in the external housing and secured in place if required. In order to increase the strength of the distributor it is possible to have a reinforcing ring, as for instance one of round wire, at the tips of the guide vanes.

It is furthermore to be added that certain data for the size the fan unit may be selected within particularly suitable ranges. For instance the breadth of the gap between the guide vane edge and the impeller vane outer edge $d_3$- $d_2$ may be approximately 0.1 to 0.2 $d_2$ and preferably 0.13 $d_2$. To take another instance, the thickness of the guide vanes D - $d_3$ may be approximately 0.05 to 0.5 $d_2$ and preferably 0.27 $d_2$.

Variations and modifications of the present invention are possible without departing from the scope and spirit as defined in the appended claims.

The embodiments of the invention in which an exclusive property or privilege is claimed are defined as follows:

1. A fan unit characterized by:

a tubular external housing which has inlet and outlet connectors placed coaxially one behind the other, a radial impeller mounted in the housing without any spiral housing and arranged so as to operably rotated by a motor drive, said radial impeller having backwardly directed vanes for impelling a gaseous medium, a distributor surrounding the radial impeller externally and placed downstream from the impeller, said distributor being mounted on an inner side of the housing and having a plurality of guide vanes extending axially and evenly arranged around the periphery, said vanes being adapted to deflect the flow of impelled fluid emerging in the radial direction, from said impeller to an axial direction and which are so inclined at an angle of attack, which is selected in accordance with the direction of emergence of the impelled fluid towards the axis of rotation of the radial impeller that a smooth even flow transition takes place in the distributor; said distributor characterized by a ring of guide vanes coaxially surrounding the impeller with a clearance gap of substantially constant width between the inner edges of the guide vanes and the associated outer edges of the impeller vanes, the beginning of the guide vanes in the axial flow direction is positioned behind the beginning of the impeller vanes at their outer periphery and the guide vanes extend downstream of the impeller vanes, and the middle section of the guide vanes have an inwardly directed bend in the place of the vane such that the first respective half of their longitudinal center axis forms an obtuse angle with the second half thereof which is less than 180 degrees.

2. The fan unit as claimed in claim 1 comprising a nozzle-like inlet running in the direction of flow centrally and pointing towards the interior of the impeller from the end wall of the external housing at the inlet end and the outlet end wall of the external housing has centrally arranged nozzle-like intake extending in the direction of flow away from the impeller towards the exterior.

3. The fan unit as claimed in claim 1 wherein at the said bend the inner edge of the guide vane edge extends towards the impeller in the form of a step.

4. The fan unit as claimed in claim 3 wherein at such inwardly extending step the internal diameter of the guide vane suddenly decreases and from this step onwards the inner edge of the guide vane extends obliquely inwards.

5. The fan unit as claimed in claim 4 wherein as seen in the direction of flow the step is placed behind the end of the guide vane by a distance which is approximately equal to the width of said clearance gap.

6. The fan unit as claimed in claim 1 wherein in the radial direction the guide vanes extend in a straight form in a plane passing through the axis of rotation of the impeller.

7. The fan unit as claimed in claim 1 wherein the guide vanes are curved in the axial direction in a manner conforming to a circular arc.

8. The fan unit as claimed in claim 7 wherein the ratio between the radius of such arc and the external diameter of the impeller is equal between 0.63 and 0.8 to 1.

9. The fan unit as claimed in claim 1 wherein the exit edges of the guide vanes extend in a direction which is substantially parallel to the axis.

10. The fan unit as claimed in claim 1 wherein the inlet edges of the guide vanes are set at an angel of approximately 20 to 30 degrees against the direction of rotation of the impeller.

11. The fan unit as claimed in 1 wherein the number of guide vanes is approximately equal to 1.5 to 2.5 times the number of impeller vanes.

12. The fan unit as claimed in claim 1 wherein the diameter of the external housing is such that the ratio between it and the external diameter of the impeller is between 1.25 and 1.6 to 1.

13. The fan unit as claimed in claim 1 wherein the ratio between the axial length of the external housing and its diameter is between 0.64 and 0.8 to 1.

14. The fan unit as claimed in claim 1 wherein the ratio between a line as measured in the axial direction between the start of such impeller vane and the start of such guide vane on the one hand and the length of the impeller vane on the other hand is between 0.1 and 0.2 to 1.

15. The fan unit as claimed in claim 1 wherein the maximum internal diameter of such guide vane is approximately 1.1 to 1.2 times the external diameter of the impeller.

16. The fan unit as claimed in claim 1 wherein the ratio between the diameter at the tip of such guide vane on the outlet side and the diameter of the nozzle-like intake on the outlet side is between 1.3 and 1.6 to 1.

17. The fan unit as claimed in claim 1 wherein the ratio of the distance of the tip on the outlet side of such guide vane from the outlet side end wall of the external housing to the diameter of the external housing is between 0.02 and 0.05 to 1.

18. The fan unit as claimed in claim 1 wherein the ratio between the distance of the end of such impeller vane remote from the intake nozzle and the inwardly extending step on the inner edge of such impeller vane to the external diameter of the impeller is between 0.03 and 0.06 to 1.

19. The fan unit as claimed in claim 1 wherein the external diameter of such impeller vane and the maximum internal diameter of such guide vane at the inwardly projecting step are generally equal in size.

20. The fan unit as claimed in claim 1 wherein the width of the gap between the inner edge of the guide vane and the external edge of the impeller vanes is approximately equal to 0.1 to 0.2 times the external diameter of the impeller vane.

21. The fan unit as claimed in claim 1 wherein the thickness of the guide vanes is equal to between approximately 0.05 and 0.5 times the external diameter of the impeller vane.

22. The fan unit as claimed in claim 1 wherein the length of the guide vanes as measured in the axial direction is greater than the length of the vanes of such impeller, the guide vanes are bent along an arc, the ratio between the radius of such arc and the external diameter of the impeller is equal to 0.7 to 1, the inlet edges of the guide vanes are set at an angle of approximately 25 degrees against the direction of rotation of the impeller, the diameter of the external housing is such that the ratio between it and the external diameter of the impeller is 1.4 to 1, the ratio between the axial length of the external housing and its diameter is 0.7 to 1, the ratio between a line as measured in the axial direction between the start of such impeller vane and the start of such guide vane on the one hand and the length of the impeller vane on the other hand is 0.16 to 1, the maximum internal diameter of such guide vane is approximately 1.13 times the external diameter of the impeller, the ratio between the diameter at the tip of such guide vane on the outlet side and the diameter of the nozzle-like intake on the outlet side is equal to 1.45 to 1, the ratio between the distance of the tip on the outlet side of such guide vane from the outlet side end wall of the external housing to the diameter of the external housing is equal to 0.03 to 1, the ratio between the distance of the end of such impeller vane remote from the intake nozzle and the inwardly extending step on the inner edge of such guide vane to the external diameter of the impeller is equal to 0.045 to 1, the external diameter of such impeller vane and the maximum internal diameter of such guide vane at the inwardly projecting step have a ratio between them of between 1. to 0.8 and 1 to 1.1 with a preferred value of 1 to 0.96, the width of the gap between the inner edge of the guide vane and the external edge of the impeller vane is approximately equal to 0.13, times the external diameter of the impeller, and the thickness of such guide vanes is equal to approximately 0.27 time times the external diameter of the impeller.

* * * * *